US005269861A

United States Patent [19]

Gilbreath

[11] Patent Number: 5,269,861

[45] Date of Patent: Dec. 14, 1993

[54] STRUCTURE AND METHOD FOR REPAIR OF SHEETROCK WALLS

[76] Inventor: Lindsey W. Gilbreath, #7 C.R. 5336-3025 B, Farmington, N. Mex. 87401

[21] Appl. No.: 901,273

[22] Filed: Jun. 19, 1992

Related U.S. Application Data

[63] Continuation-in-part of Ser. No. 681,322, Apr. 4, 1991, abandoned.

[51] Int. Cl.[5] ..... B32B 35/00; E04G 23/02

[52] U.S. Cl. ..... 156/98; 29/402.11; 52/514; 156/71; 428/63

[58] Field of Search ..... 428/258, 355, 423, 63; 156/98, 94, 71; 264/36; 52/514; 29/402.11

[56] References Cited

U.S. PATENT DOCUMENTS

| | | | |
|---|---|---|---|
| 2,997,416 | 8/1961 | Helton | 156/98 |
| 3,325,955 | 6/1967 | Haut | 52/514 |
| 3,576,091 | 4/1971 | Shull | 156/71 |
| 3,583,122 | 6/1971 | Biegajski | 52/514 |
| 3,853,598 | 12/1974 | Raguse | 428/258 |
| 3,874,505 | 4/1975 | Mirarchi et al. | 52/514 |
| 4,100,712 | 6/1978 | Hyman | 52/514 |
| 4,152,877 | 5/1979 | Green | 52/514 |
| 4,178,730 | 12/1979 | Rowinski | 52/514 |
| 4,285,183 | 8/1981 | Condit | 52/514 |
| 4,297,823 | 11/1981 | Keisler | 52/514 |
| 4,311,656 | 1/1982 | Spriggs | 52/514 |
| 4,354,656 | 10/1982 | Lentz | 52/514 |
| 4,358,495 | 11/1982 | Parker | 156/71 |
| 4,464,869 | 8/1984 | Parkin | 52/514 |
| 4,564,010 | 1/1986 | Coughlan | 428/355 |
| 4,620,407 | 11/1986 | Schmid | 52/514 |
| 4,776,906 | 10/1988 | Bernard | 156/94 |
| 4,930,281 | 6/1990 | Martin et al. | 52/514 |
| 5,017,625 | 5/1991 | Ansell | 428/423.1 |
| 5,018,331 | 5/1991 | Forzano | 52/514 |

*Primary Examiner*—Michael W. Ball
*Assistant Examiner*—Daniel J. Stemmer
*Attorney, Agent, or Firm*—Kenton L. Freudenberg; Maxwell C. Freudenberg

[57] ABSTRACT

A structure and method for repairing a damaged section in a sheetrock wall or ceiling comprising removal of the damaged section by cutting out a specifically-sized section of the wall surrounding the damaged section, providing a like-size, tight-fitting replacement section in the cutout area, providing a combination of fabric strips impregnated with an unactivated fast-setting plaster or cementitious material, providing a water-based glue, coating the edges of the replacement section and the cutout area with the water-based glue, activating the cementitious material, positioning fabric strips on the back side of the replacement patch with ends of the strips extending beyond each edge of the replacement patch, inserting the replacement section of sheetrock into the cutout area and manipulating it into flush alignment with the wall surface by manually gripping the patch assembly using the extended portions of the plaster impregnated strips, flattening the extended portions of the strips against the wall surface, allowing the cementitious material and water-based glue to harden, and trimming away exposed portions of the strips on the wall surface, thus creating a securely bonded integral patched part of the sheetrock, which restores the panel to near its original strength and finish.

15 Claims, 2 Drawing Sheets

STRUCTURE AND METHOD FOR REPAIR OF SHEETROCK WALLS

This application is a continuation-in-part of application Ser. No. 07/681,322 filed Apr. 4, 1991, now abandoned.

BACKGROUND OF THE INVENTION

This invention pertains to a repair patch to make a permanent repair of a hole, puncture, or concavity, in a sheetrock wall or ceiling.

In the late 1940's the use of gypsum board panels, typically referred to as "sheetrock" or "drywall", became the preferred building material for interior walls and partitions in most types of buildings in the United States, primarily because of the relatively low cost of material and installation. These panels are essentially made of a hardened plaster-like gypsum material which is sandwiched between sheets of paper or cardboard material. Sheetrock panels, which can by cut to size using only a utility knife, are typically nailed or screwed to spaced wooden studs or joists to provide a flat wall or ceiling surface which spans these wooden supporting members, leaving the space between the studs or joists hollow behind the wall surface. The surface of a sheetrock wall is typically finished by filling irregularities and indentations, such as those in the areas where nails or screws have been driven through the face of the panel. The slight gaps between panels are similarly filled and taped over using paper tape which is sufficiently wide to bridge the gap between panels and which is held in place by the filler material. The filler is "drywall compound," a mud-like material which is smoothed into place and allowed to dry and harden. However, even the dried filler material has relatively little structural integrity and provides primarily the cosmetic benefit of a smooth wall or ceiling surface. The filler material by itself also has a tendency to shrink somewhat while drying and is therefore susceptible to cracking, particularly where it is used in large quantities or in thick layers.

Sheetrock panels installed in this manner serve well for interior use as walls and ceilings. A typical interior wall will have two external wall surfaces, each wall surface being the external surface of one of two parallel sheetrock panels which are spaced apart and secured to opposite sides of the wooden studs.

The primary drawback to using sheetrock material is that it is easily damaged by a sudden blow applied to a small area, such as that which may be caused by the protruding door knob of a swinging door. The material is also susceptible to being puncturing by sharp objects. Also, removal or relocation of an electrical outlet or switch box during remodeling may leave a hole that must be filled or covered.

A simple, easy to use and inexpensive method for repairing holes in sheetrock walls to restore the damaged or missing part of the wallboard, has eluded inventors, drywall professionals, handymen-homeowners, and building maintenance personnel, for as long as such materials have been in common use. Such repair can be relatively difficult, especially in the most common situation where the hole is located over the void between two wall studs and extends completely through the drywall into this void. In such a situation, and particularly if the hole is greater than about one (1) inch in diameter, the use of any semi-liquid or paste-like hardening filler material such as drywall compound, plaster or spackling compound is generally not practical, since the void behind the hole provides no support for the filler, thus allowing the filler to fall through into the hollow space behind the hole. Previously, similar difficulties have arisen in connection with using a solid patching material such as a piece of wood or drywall since there has been no convenient way of both positioning the patch flush with the outer face of the wall surface and supporting it in place.

SUMMARY OF THE INVENTION

The present invention overcomes the aforementioned difficulties by providing a precisely fitting patch member for a damaged wall section and means for precisely adjustably aligning or positioning the patch member flush with the outer face of the wall surface, and securely bonding the patch member in place so that it becomes an integral part of the wall or ceiling panel being repaired.

Examples of prior art methods and devices are shown in U.S. Pat. No. 3,936,988 to Miceli (1976), and U.S. Pat. No. 4,408,429 to Neal (1983). Each uses a plugging device that is inserted through the hole being repaired into the hollow wall area and secured onto the inner surface of the rear or opposing drywall panel to hold a plunger-like device against the inside rear edge of the damaged drywall panel. This is used as a back stop for a filler compound. Both of these units are expensive to manufacture, difficult to install, and require an unnecessarily large quantity of filler compound to make a strong repaired area.

U.S. Pat. No. 3,583,122 to Biegajski (1971) consists of a repair patch that is inserted through the hole in wall being repaired, and requires a long machine screw to anchor it to the rear or opposing drywall panel. This device is awkward to install and, due to the large amount of filler required, makes a very weak patched area. In contrast to these prior art devices, the present invention requires no internal surface within the wall upon which the device or patch may be mounted. Such an opposing internal surface will most often not exist in the void behind a drywall ceiling.

U.S. Pat. No. 3,874,505 to Mirarchi et al (1975) shows a wall repair kit having a folding patch member of wall material surrounded by a thin border material which is part of a backplate of rigid material which is folded to be inserted through a hole in the wall and is then pulled forwardly into place the backplate against the back face of the wall panel where its thin border material is adhered to the back of the wall panel around the hole's periphery.

The present invention, in contrast, to each of the aforementioned devices is also useful where the area to be repaired lies directly over a supporting stud, or where there is little depth behind the wall surface being repaired, which may prevent or hinder the insertion of any hardware into the space behind the wall. In such circumstances while it is also generally desirable to have a patch member which is no thicker than the thickness of the wall panel, the present invention allows use of a patch member which is thinner than the wall panel but which may still be adjustably aligned or installed flush with the outer face of the wall surface.

U.S. Pat. No. 2,997,416 Helton (1961) consists of a complex bracing apparatus which holds a backing plate and triangular shaped front bracket over a hole while the repair is being done. This apparatus is difficult to install and requires that the hole remaining in the new section, caused by a rod-like device being inserted through the new plug during installation, must then be filled with filler compound after the original repair has dried, making this repair a two step procedure. U.S. Pat. No. 4,178,730 Rowinski (1979) shows a drywall repair kit which uses a plurality of clips to hold a piece of drywall material in place so that the openings around it can be caulked with filler. This kit leaves a weak repair due to the difficulty of thoroughly caulking the openings surrounding the new drywall patch. Most of the above, prior art devices, in effect, become filler holders and do not effectively solve the primary problems of using a filler as a patch, those problems being sagging, shrinking and/or cracking of the filler material, which result in a relatively weak and brittle repair.

The present invention, unlike prior art, provides a simple, quick, easy to use, and inexpensive method to make a strong permanent repair to a damaged sheetrock wall or ceiling. The newly repaired wall section is strong enough to allow the hanging of pictures, towel racks and the like. This repair patch can be useful in filling a void in a sheetrock wall made by the removal or relocation of an electrical outlet or switch box during a remodel project. The present repair patch can also be used to repair a hole in a sheetrock ceiling, without the need to gain access to the top side of the panel.

Furthermore, the present repair patch for sheetrock walls has the additional advantage of permitting ease of installation, and does not require cumbersome equipment and materials to do the repair. It provides a simple, inexpensive means of repair that a novice, or one not skilled in the art, could successfully use. It provides a good, strong repair that requires a minimum amount of filler compound. It assures a superior manner of bonding of a replacement section into the area being repaired by the effective combination of fast-setting plaster-bandage and water-based glue. It provides a means of inserting and aligning a replacement section into a wall being repaired, working only from the front side of a wall. It provides a repaired section of sheetrock wall, strong enough that a picture, towel rack anchor, or the like, could be anchored therein. It provides a sheetrock repair method that restores a damaged section to very near its original state in strength and appearance.

It is an object of the present invention to provide a method and structure for repairing a damaged wall or ceiling wherein the structure does not require the use of any hardware beyond that which is used for the patch itself.

It is another object of the present invention to provide a method of repairing a damaged section of sheetrock which requires no supporting structure during setup other than the patch structure itself.

It is a further object of the present invention to provide a strong wall repair using a minimum amount of filler compound.

It is another object of the present invention to provide a simple, easy to use, inexpensive method to repair holes in sheetrock walls that most people, not skilled in the arts, could successfully use.

It is another object of the present invention to provide a repaired section of sheetrock wall sufficiently strong to support a picture, towel rack anchor, or the like.

It is an object of the present invention to provide a superior means of bonding a replacement section to the inside perimeters of a cavity in a sheetrock wall It is another object of the present invention to provide a means of inserting and aligning a replacement section into a wall being repaired, from the front side of a wall without requiring access to the inside of the hollow wall.

It is another object of the present invention to provide a means of inserting and aligning a replacement section into a wall being repaired, from the front side of a wall without requiring the protrusion beyond the rear surface of the wall of the patch or any supporting material or hardware.

It is another object of the present invention to provide a drywall repair method that will restore a damaged section to very near its original state in both strength and finish.

It is another object of the present invention to provide a repair method for a hole in a sheetrock ceiling.

Further objects and advantages of the present invention will become apparent from a consideration of the drawings and ensuing description.

DESCRIPTION OF THE PREFERRED EMBODIMENT

Figure 2:
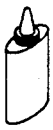
FIG. 2 shows a representation of a squeeze-type container of water-based glue.
Figure 5:
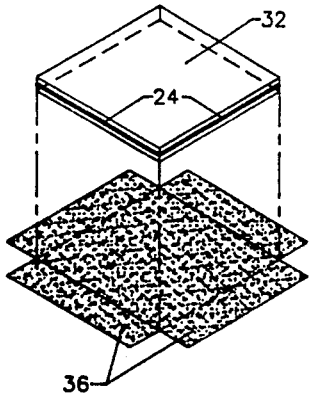
FIG. 5 is a perspective view of the patch assembly comprising a patch member and two pieces of plaster-bandage used as patch material, before installation of the patch assembly into a wall.

A kit structure of the preferred embodiment of the present invention, as illustrated in FIGS. 2 and 5, comprises a patch member 32, a marking template of the same size and shape as the patch member, patching material 36, and water-based adhesive. In the preferred embodiment the patch member is a precut square section of gypsum board or sheetrock. The marking template or pattern may be the patch member itself or an identically sized section of cardboard. The patching material comprises two strips of "Specialist", fast-setting plaster-bandages. "Specialist" is a trademark of Johnson & Johnson Co., New Brunswick, N.J. Any similar fine mesh cotton fabric material or porous web material carrying unactivated plaster or any similar cementitious compound is suitable. A suitable water-based adhesive is "Elmer's Glue All". "Elmer's Glue All" is a trademark of Bordens Inc., Columbus, Ohio.

Figure 3:
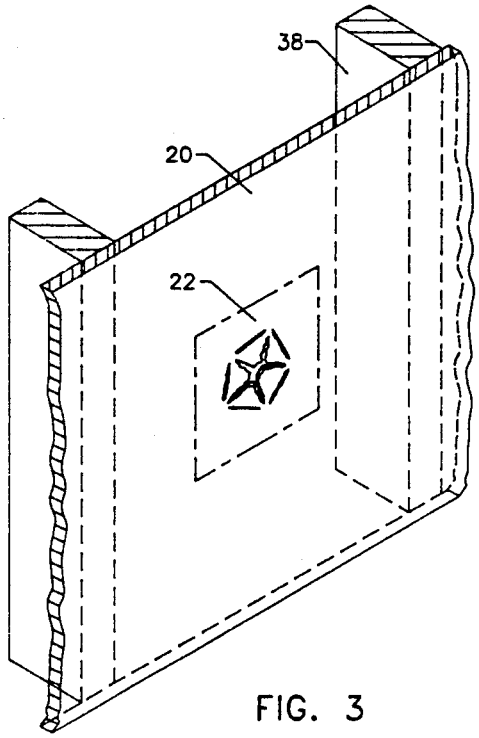
FIG. 3 is a perspective view of a representative section of damaged sheetrock wall.
Figure 4:
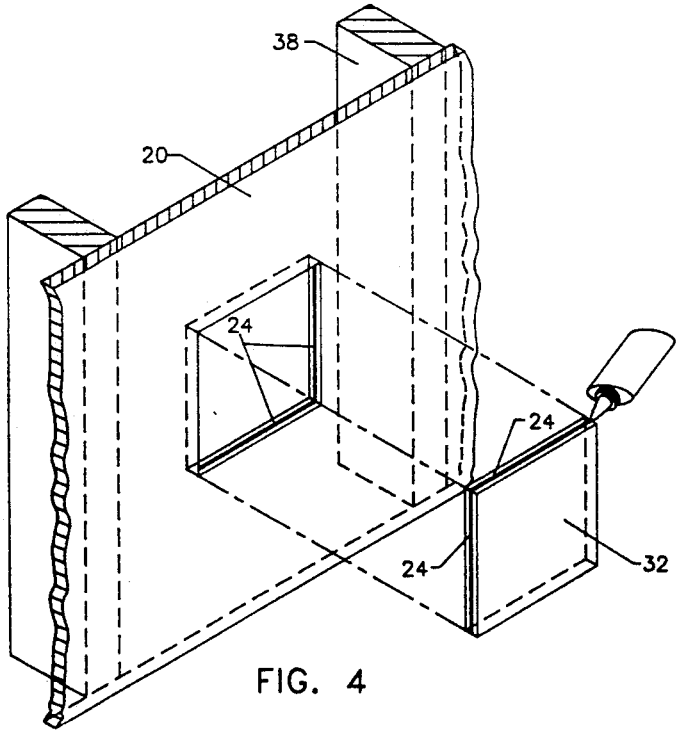
FIG. 4 is an perspective view of a representative section of a sheetrock wall with section cut out, illustrating glue being applied to outwardly exposed perimetral faces at the outer edges of a patch member and to the inwardly exposed faces at the complementary inside perimeter of the cut out section of the wall.

The method of the preferred embodiment comprises using the structure as described above and carrying out the following steps:

First, by tracing around the template, a rectangular or square area surrounding and including the damaged section of the wall is marked as shown in FIG. 3. Such an area may typically be 4 inches square. The marked area is removed by cutting it out of the wall using a thin bladed sharp pointed saw. While it is preferable that the patch member have the same thickness as the wall panel to be repaired, this is not necessary in every case. While a patch member may be provided which is precut to a size matching that of the template and cut-out section of wall, a like-size patch member may also be cut from an existing piece of surplus or scrap sheetrock, using the template as a guide. The respective opposed faces of the edges of both the patch member 32 and the inside perimeters of the cut-out in the wall which are to be bonded together are cleaned of excess loose gypsum using a small brush. These same faces of these edges are then slightly moistened using a small sponge saturated with water. As shown in FIG. 4, a bead of the water-based glue is applied along each of the inwardly exposed faces at the edge of the wall cut-out and along each of the outwardly exposed faces at the outside edges of the patch member 32. The opposed faces of the patch member and the cut-out wall section which are to be bonded together extend generally perpendicularly to the outer exposed face of the wall being repaired.

Figure 1:
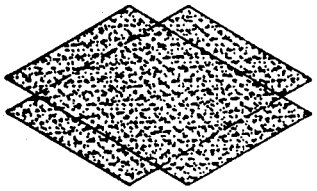
FIG. 1 is a perspective view of two crossed strips of "fast-setting" plaster- bandage used as patch material.
Figure 6:
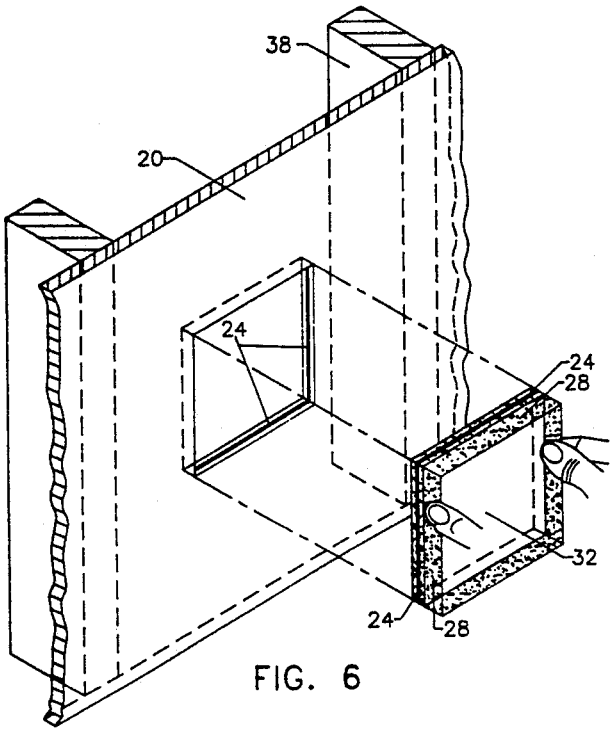
FIG. 6 is a perspective view showing the patch assembly being manually inserted into the cut-out of a representative section of a sheetrock wall.
Figure 7:
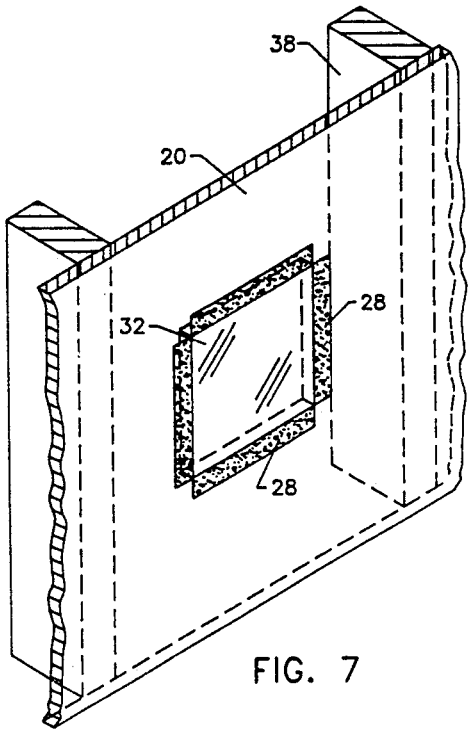
FIG. 7 is a perspective view of a representative section of a sheetrock wall after insertion of the patch assembly.
Figure 8:
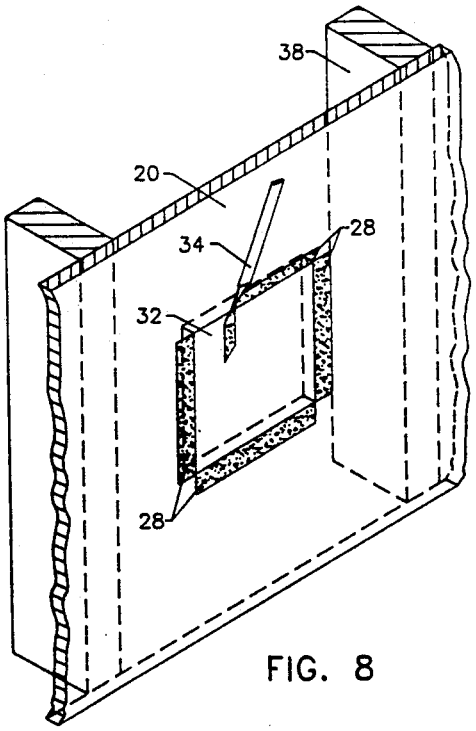
FIG. 8 is a perspective view of a representative section of a sheetrock wall illustrating the trimming of excess plaster-bandage patching material.
Figure 9:
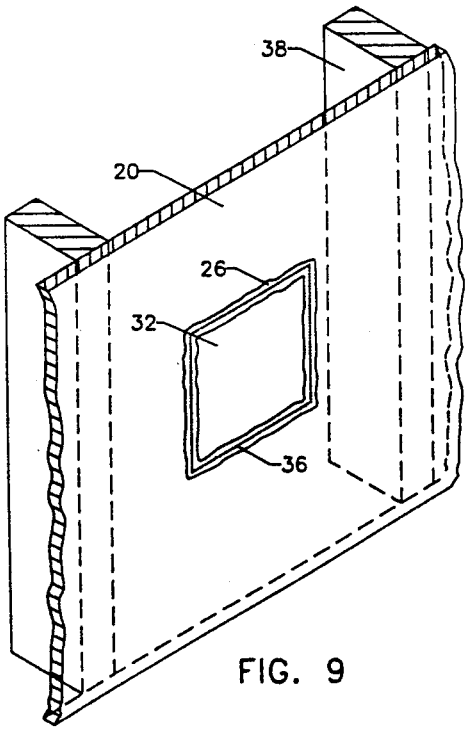
FIG. 9 is a perspective view of a representative section of a sheetrock wall after spackling compound has been applied.

Two lengths of the plaster-bandage patch material shown in FIG. 1 are cut, each being approximately three inches longer than the length and width of the patching member 32. Each strip of patch material is moistened with water by soaking to activate the plaster compound. As shown in FIG. 5, these strips 36 are then placed across the back of the patch member, with the strips oriented at right angles to one another and so that each strip is centered on the patching member. Each end of each strip thus extends beyond the corresponding edge of the patch member. As seen in FIGS. 5 and 6, the patch assembly insert structure comprising the patch member 32 and the glue-impregnated patching material 36 may be manually gripped by means of the extended edges 28 of plaster-bandages 36 while simultaneously pressing against the patch member 32 with the thumbs and inserted into the wall cut-out where it is manipulated to a position where its exposed face is adjustably aligned flush with the outer exposed wall surface. Once the patch assembly is in position the extended edges 28 of the plaster-bandage patching material are pressed flat against the wall surface to the outside of the cut-out area, and away from the new replacement section as shown in FIG. 7. These extended edges will thus adhere to the surface of the sheetrock wall 20, until the repaired section has dried and set-up. The strips, impregnated and permeated with glue, will provide the principal support interface means for permanently anchoring the sheetrock patch member to the sheetrock wall and form a composite structural bridge in the space between the opposed perimetral faces of the patch member and the cut-out wall area. The drying or setup time can be decreased by directing heat from an incandescent light, heat lamp or other heat source to the patched area. As shown in FIG. 8, after the repaired section has dried, the excess portion 28 of the patch material may be trimmed away from the wall surface using a razor blade or scraper 34 by loosening the excess plaster-bandage from wall and then cutting off the excess pieces. As seen in FIG. 9, the wall surface may then be finished in a normal manner, using a small amount of drywall or spackling compound 26 and a putty knife to fill in and smooth the small indentations around edges of the new section 32. After spackling compound dries, sandpaper or a wet sponge may be used to smooth the repaired area if needed. The repaired wall section may be textured and/or painted in the usual manner. It is believed that the success of this invention stems from the interaction of (1) the gypsum in the sheetrock wallboard, (2) the water soaked fast-setting plaster-bandage, which contains fibers, (3) the gypsum and adhesive compounds, and (4) the water-based glue, to form a highly compatible cohesive bond forming the composite structural bridge to anchor the patch member to the wall. This interaction results in a repaired area that is essentially as strong as the original sheetrock.

Although the description above contains many specificities, these should not be construed as limiting the scope of the invention but as merely providing illustrations of some of the presently preferred embodiments of this invention. For example, the repair sections can have a multiplicity of other sizes and shapes, such as circular, rectangular, square or triangular, by the use of different templates or patterns. This repair patch can be used to repair a hole in a sheetrock ceiling, simply by supporting the newly repaired section from below, with a flat object until it dries. In the preferred embodiment, when the ends of the crossed strips 36 are wrapped up around the edges of the patch member, as seen in FIG. 6, there is only one thickness of the fabric material at each side edge of the patch member, keeping the thickness of this portion of the patch structure uniform. Other configurations using two or more differently shaped strips of the plaster-bandage material may be used and still retain this uniform thickness. In some instances, particularly for larger sizes of patch members, it may be practical to use the water-based adhesive, or other means such as staples, to initially secure first portions of strips to the rear side of the patch member, although not necessarily covering its entire rear surface, before wrapping the strips up around all edges with second manually grippable portions of the strips extending forwardly beyond the front side of the patch member, and before performing the insertion portion of the described method of patching. It is important that the strips engage or be secured to the rear side of the patch member over at least a sufficient portion to ensure that the user can pull on the ends of the strips as necessary to resist forces applied manually while pushing on all or part of the front side of the patch member as it is inserted into place, thereby enabling manipulation of the patch member to align its face flush with the face of the wall being repaired. Likewise the repair patch can be readily adapted to other materials such as waferboard panels, plywood, hollow-core wood door panels or the like, by substituting the bonding agents and materials, to agents compatible with the type of material being repaired.

Accordingly, the scope of the invention should be determined not by the embodiments illustrated, but by the appended claims and their legal equivalents. Other variations within the scope of this invention will be apparent from the described embodiment and it is intended that the present descriptions be illustrative of the inventive features encompassed by the appended claims.

What is claimed is:

1. A repair method for patching a flat thin wall having a damaged area in an exposed surface thereof, which method comprises the steps of:

cutting out a replacement area of said wall including said damaged area in accordance with a desired shape to define a replacement aperture in the wall, selecting a replacement patch member to fit closely within said replacement aperture, preparing portions of a porous web material with first portions of the material placed to extend along at least part of the rear side of the member and with manually grippable second portions of the material placed to extend around the edges of the member and forwardly beyond the front side of the member, said first portions resisting rearward movement of said member when manual pressure is applied in a rearward direction to the front side of the member while said second portions are manually grasped by a user during insertion of the member into the aperture, preparing an insert structure comprising said replacement patch member and said material so placed thereon with an adhesive material interface permeating said web material at least at the portions thereof which are to lie between opposed faces of the edge of the patch member and the edge of the aperture in the wall, inserting said insert structure into said aperture by manually grasping said second portions of the material and pushing said structure into the aperture, using manual pressure on the member to adjust alignment of the front side of the member flush with the outer surface of the wall adjacent the aperture, keeping said member relatively immovable within the aperture until the adhesive material interface hardens to form a structural bridge between the opposed faces of the edge of the replacement patch member and the edge of the aperture in the wall, removing excess portions of the web material at the front side of the member around the patched replacement area of the exposed wall surface, and finishing said patched area wherein there is no supporting structure protruding beyond the rear surface of the wall.

2. A repair method for patching a flat thin wall according to claim 1 wherein said porous material is a fine mesh fabric.

3. A repair method for patching a flat thin wall according to claim 1 wherein said porous material is a fine mesh cotton fabric.

4. A repair method for patching a flat thin wall according to claim 1 wherein said porous material is a single sheet of fabric covering the rear side and edges of the replacement patch member.

5. A repair method for patching a flat thin wall according to claim 1 wherein said adhesive material interface comprises a water-based glue.

6. A repair method for patching a flat thin wall according to claim 1 wherein said adhesive material interface comprises a cementitious material.

7. A repair method for patching a flat thin wall according to claim 1 wherein said adhesive material interface comprises a glue mixed with a cementitious material.

8. A repair method for patching a flat thin wall according to claim 1 wherein said adhesive material interface comprises a water-based glue mixed with a cementitious material.

9. A repair method for patching a flat thin wall according to claim 7 wherein said cementitious material is plaster of paris.

10. A repair method for patching a flat thin wall according to claim 1 wherein said finishing includes use of spackling compound around the patched area.

11. A repair method for patching a flat thin wall according to claim 1 wherein said thin wall is made of a panel fabricated with wood.

12. A repair method for patching a flat thin wall according to claim 1 wherein said web material is a porous fabric containing throughout its porous structure an un-activated cementitious material, and said adhesive material interface includes a quantity of water-based glue for impregnating said fabric and cementitious material.

13. A repair method for patching a flat thin wall according to claim 12 wherein said fabric and said cementitious material are preformed together.

14. A repair method for patching a flat thin wall according to claim 12 wherein the shape of said aperture is determined by pattern means for applying to the surface of a damaged wall indicia defining an area to be cut out to define the replacement aperture for insertion of the replacement patch member.

15. A repair method for patching a flat thin wall according to claim 1 wherein said wall is a sheetrock panel and said adhesive material interface comprises a water-based glue mixed with a water-activated cementitious material.

* * * * *